US007011221B2

(12) United States Patent
Smith et al.

(10) Patent No.: US 7,011,221 B2
(45) Date of Patent: Mar. 14, 2006

(54) ANTI-LEAK DUST COVER AND CLOSURE USED THEREWITH

(75) Inventors: Robert J. Smith, Edinboro, PA (US); Matthew E. Stebick, Waterford, PA (US)

(73) Assignee: Erie Plastics Corporation, Corry, PA (US)

( * ) Notice: Subject to any disclaimer, the term of this patent is extended or adjusted under 35 U.S.C. 154(b) by 396 days.

(21) Appl. No.: 09/683,761

(22) Filed: Feb. 11, 2002

(65) Prior Publication Data

US 2003/0121879 A1 Jul. 3, 2003

Related U.S. Application Data

(60) Provisional application No. 60/345,312, filed on Jan. 2, 2002.

(51) Int. Cl.
*B65D 39/00* (2006.01)

(52) U.S. Cl. ..... 215/251; 222/153.6; 220/257.1

(58) Field of Classification Search ..... 215/251, 215/252–256, 901, 216, 217, 331, 334; 222/153.1, 222/153.2, 153.06, 153.07, 153.14, 525, 222/524; 220/257.1, 257.2, 257.5, 265, 266, 220/251

See application file for complete search history.

(56) References Cited

U.S. PATENT DOCUMENTS 3,910,463 A * 10/1975 Reese ..... 222/153.14
4,805,807 A * 2/1989 Perne et al. ..... 222/153.06
5,096,077 A * 3/1992 Odet et al. ..... 215/211
5,104,008 A * 4/1992 Crisci ..... 222/153.07
5,265,777 A * 11/1993 Weinstein ..... 222/517
5,328,063 A * 7/1994 Beck et al. ..... 222/524
5,429,255 A * 7/1995 Glynn ..... 215/223
5,813,575 A * 9/1998 Glynn et al. ..... 222/182
5,829,611 A * 11/1998 Beck ..... 215/252
5,975,369 A * 11/1999 Yurkewicz et al. .... 222/153.06
5,992,692 A * 11/1999 Boissay ..... 222/83
6,050,452 A * 4/2000 Pradinas ..... 222/153.02
6,095,375 A * 8/2000 Adams et al. ..... 222/182
6,321,924 B1 * 11/2001 Yurkewicz et al. ..... 215/251
6,827,239 B1 * 12/2004 Lasserre et al. ..... 222/153.11
2003/0034347 A1 * 2/2003 Dewig et al.

* cited by examiner

*Primary Examiner*—Lien M. Ngo
(74) *Attorney, Agent, or Firm*—Blynn L. Shideler; Krisanne Shideler; BLK Law Group

(57) ABSTRACT

A container closure includes a shell attachable to a container around a container opening thereof. The shell has a shell opening in fluid communication with the container opening when the shell is attached to the container. A tip is received on the shell movable between a closed position sealing the shell opening and an open position. A cover is releasably attached to the shell in a manner indicative of the tip being positioned in the closed position when the cover is attached to the shell. The cover includes rib engaging ribs for maintaining the cover tip and shell in proper alignment when the cover is attached to the shell.

15 Claims, 2 Drawing Sheets

ANTI-LEAK DUST COVER AND CLOSURE USED THEREWITH

CROSS REFERENCE TO RELATED APPLICATIONS

This application claims the benefit of U.S. Provisional Patent Application Ser. No. 60/345,312, filed Jan. 2, 2002, entitled "Anti-Leak Dust Cover and Closure Used Therewith", which is incorporated herein by reference.

BACKGROUND OF INVENTION

1. Field of the Invention

The present invention relates to a dust cover with anti-leak provisions and the closure used therewith.

2. Brief Description of the Prior Art

Injection molded closures for bottles and the like have been designed in a wide variety of configurations. A push pull type closure is often formed of a slidable tip on a separate shell that is attached to the container. These types of push pull type closures have been utilized as closures for bottled water and sports drinks. Representative samples are found in U.S. Pat. Nos. 5,104,008; 5,265,777; 5,096,077; and 5,429,255. In this application the closure often includes a separate dust cover for covering the tip, at least prior to the consumer's initial use. Dust covers for these closures have been designed which reattach to the closure. An example of such a dust cover for a push pull type closure is manufactured by Erie County Plastics Corporation of Corry Pa. and described in U.S. Pat. Nos. 6,321,924 and 5,975,369 which are incorporated herein by reference.

The prior art dust cover manufactured by Erie County Plastics Corporation additionally includes a resealing flange on an underside thereof that engages with a groove on a central stem of the shell when the dust cover is reattached. This construction provides significant advantages over earlier dust cover designs. It is the object of the present invention to improve upon the dust cover described in the ''924 and ''369 patents and maintain all of the advantages of this dust cover. It is an object of the present invention to minimize leakage in the resealed closure utilizing the dust cover of the present invention. A further object of the present invention is to provide a dust cover that is easily manufactured by injection molding.

SUMMARY OF INVENTION

The above advantages are achieved with a container closure with a dust cover according to the present invention. The closure includes a shell having a body attachable to a container around a container opening thereof. The shell has a shell opening in fluid communication with the container opening when said shell is attached to the container. The shell includes a central stem with the shell opening being an annular opening surrounding said stem. An annular wall extends from the body and surrounds the annular opening with the stem attached to the annular wall. A tip is received on the shell movable between a closed position sealing said shell opening and an open position. A dust cover is releasably attached to said shell, with the cover including internally extending ribs engagable with the tip when the cover is attached to the shell.

The container closure of the invention may include a cover attaching member positioned on the stem, wherein the cover attaching member of the shell engages an attachment member on the cover to releasably attach the cover to the shell. The cover-attaching member may formed by a groove on the stem engaging the attaching member on the cover to releasably attach the cover to the shell. The tip engaging ribs of the cover may be radially positioned around an interior of the cover. The cover may include a tamper-evident band removably attached to the cover. The cover may include a top, a cylindrical side wall extending from said top, wherein the tamper-evident band is formed by a lower portion of the cylindrical side wall and at least one projection extending radially inwardly of the side wall.

These and other advantages of the present invention will be clarified in the description of the preferred embodiments taken together with the attached drawings in which like reference numerals represent like elements throughout.

DETAILED DESCRIPTION

Figure 1:
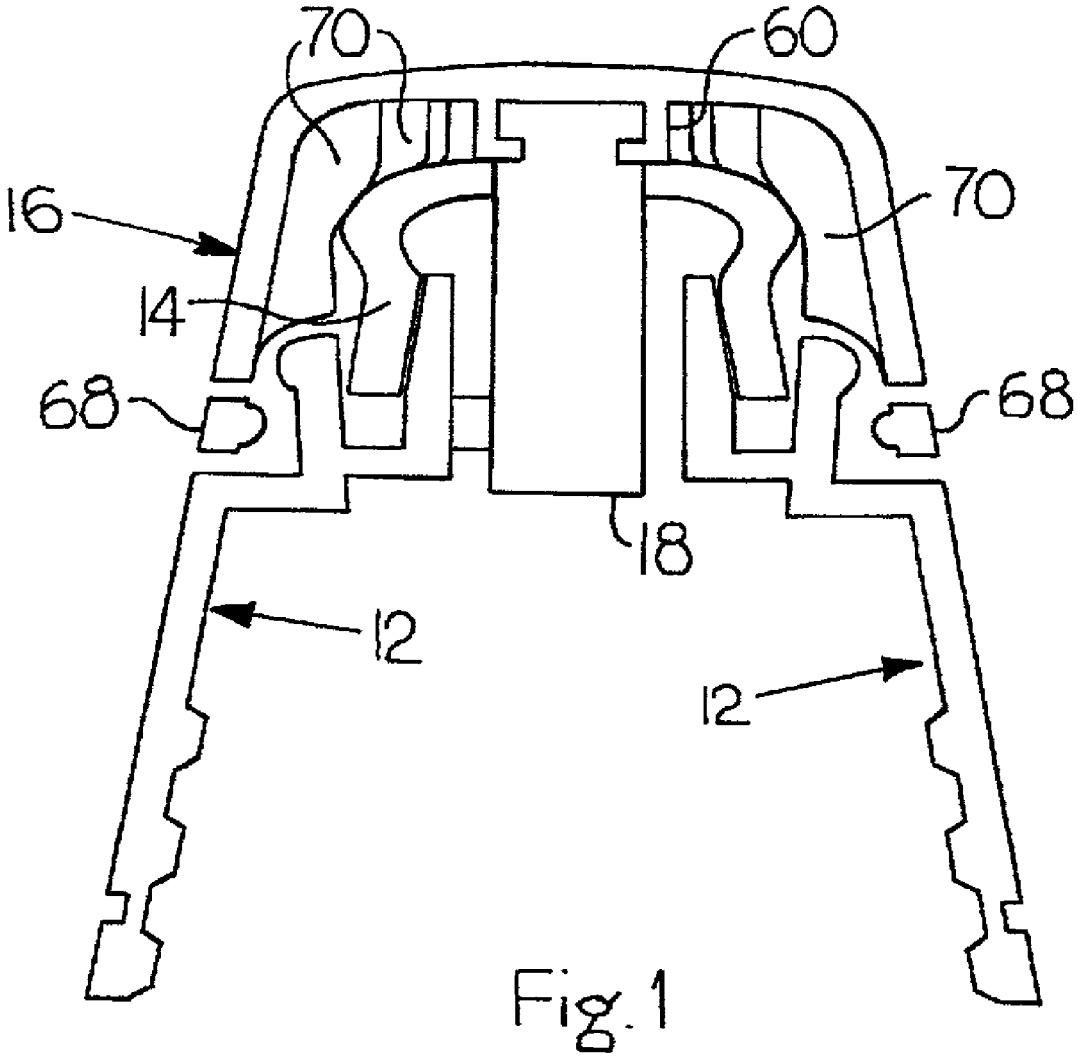
FIG. 1 is a schematic view of a an injection dust cover and associated closure according to the present invention.
Figure 2:
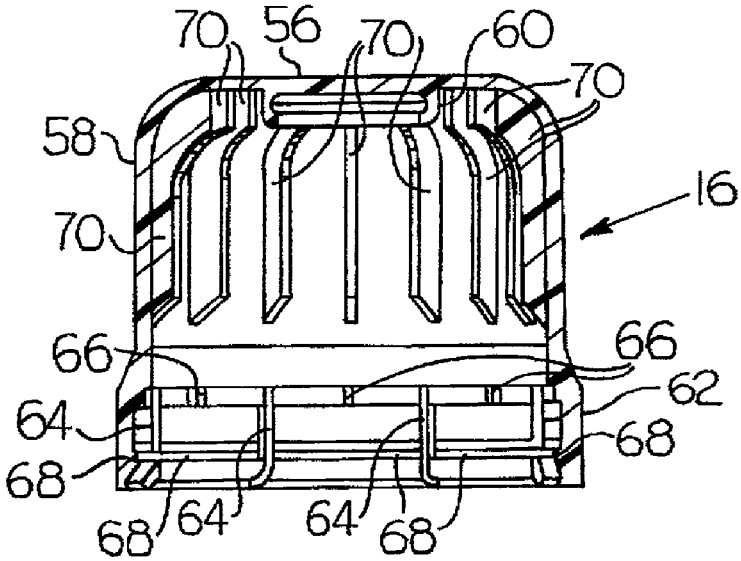
FIG. 2 is an exploded sectional view of the dust cover and closure shown in FIG. 1.
Figure 2:
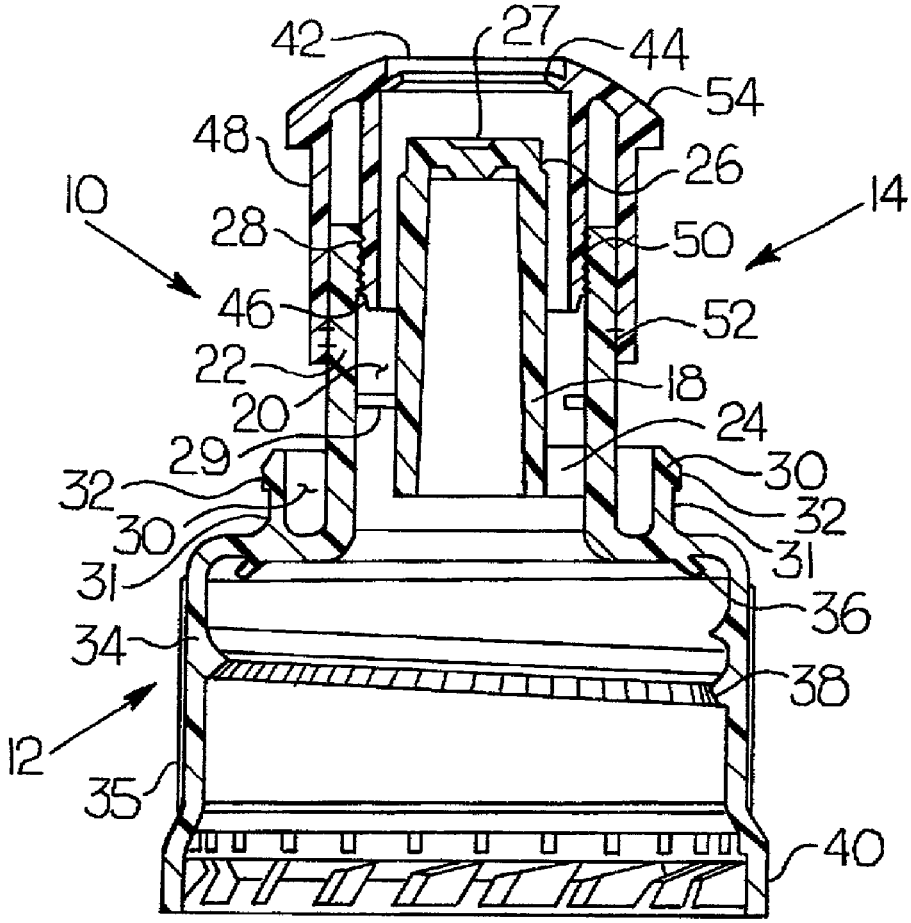

FIGS. 1 and 2 illustrates a container closure 10 according to the present invention.

The container closure 10 includes a shell 12 that is adapted to attach to a container (around a container opening thereof). A tip 14, is slidably received on the shell 12 and moveable between a closed position and an open position as will be described hereinafter. The shell 10 and tip 14 of the present invention are disclosed in U.S. Pat. Nos. 6,321,924 and 5,975,369 which are incorporated herein by reference. A dust cover 16 is releasably attached to the shell 12, with the cover 16 indicative of the tip 14 being positioned in the closed position when the cover 16 is attached to the shell 12.

The shell 12 includes a central stem 18 surrounded by an annular opening 20. The annular opening 20 is adapted to be in fluid communication with the container opening when the shell 12 is attached to the container. An annular wall 22 surrounds the annular opening 20 and is spaced from the stem 18 by a plurality of bridging elements 24.

The stem 18 includes a cover-attaching member in the form of a groove 26 around an upper portion of the stem 18. The groove 26 serves to releasably attach the cover 16. The diameter of the stem 18 may be slightly smaller above the groove 26 than below the groove 26. A gate well 27 is provided at the top of the stem 18 to prevent flashing created during the injection molding process from extending above the top surface of the stem 18, protecting the user against sharp corners and the like.

The top of the annular wall 22 includes a pair of radially inwardly extending stops 28 that are engagable with the tip 14 to stop the upwardly sliding movement of the tip 14 in the open position. The annular wall 22 may include two undercuts 29, each extending partially around the inner portion of the annular wall 22, and which cooperate with the tip 14 to create an audible click in the closed position.

The shell 12 includes an upwardly extending annular ring 30 surrounding and radially spaced from the annular wall 22. The ring 30 includes an undercut 31 positioned below a plurality of outwardly extending projections 32 formed at the upper end 30. The projections 32 essentially form a ridge around the top of the ring 30. The projections 32 at least initially attach the cover 16 to the shell 12. The projections 32 may also form a rotation-stopping mechanism relative to a portion of the dust cover 16.

The shell 12 includes a substantially cylindrical body 34 extending from the annular wall 22. A plurality of vertically extending gripping ribs 35 can be positioned on the outer cylindrical portion of the body 34 to assist in the rotation of the shell 12. A plurality of vertically extending gripping ribs 35 can be positioned on the cylindrical portion of the body 34 to assist in the rotation of the shell 12. A sealing ring 36 is attached to an inner surface of the cylindrical body 34 surrounding the annular opening 20. The sealing ring 36 is adapted to seal against the container around the container opening when the shell 12 is attached to the container. Threads 38 are formed on an inner cylindrical portion of the body 34 of the shell 12. The threads 38 are intended to cooperate with corresponding threads of the container for attaching the shell 12 to the container. A tamper-evident band 40 extends down from the cylindrical portion of the body 34. The tamper-evident band 40 may be formed in a conventional fashion such as described in U.S. Pat. Nos. 4,497,765 or 4,418,828. Specifically, the tamper-evident band 40 may include a plurality of leaders or ribs, a score line through the leaders, and a plurality of wings.

The tip 14 is slidably positioned on the shell 12 between an open and a closed position. The tip 14 includes a tip opening 42 which is adapted to be in fluid communication with the annular opening 20 of the shell 12 when the tip 14 is in the open position generally shown in FIG. 2. The tip opening 42 is surrounded by a stem-sealing member 44 which is adapted to engage with the sides of the stem 18 below the groove 26 to seal the tip opening 42 when tip 14 is in the closed position. The stem-sealing member 44 preferably seals below the groove 26. The stem sealing member 44 has a diameter slightly smaller than the sealing portion of the stem 18 below the groove 26 and the stem-sealing member 44 is adapted to flex outwardly slightly to ensure a good seal between the stem sealing member 44 and the stem 18. The tip 14 includes a sleeve member extending down from the stem sealing member 44 including an inner sleeve 46 and an outer sleeve 48. The inner sleeve 46 includes a projection formed by a radially outwardly extending annular bead 50 and the outer sleeve 48 includes a radially inwardly extending annular seal 52. The tip 14 additionally includes a grippable ledge 54 extending radially outwardly from an upper portion of the sleeve member to allow for easy grasping and movement of the tip 14 between the up, open position and the down, closed position.

The dust cover 16 includes a top 56 with a cylindrical side 58 extending down from the top 56. A plurality of gripping ribs (not shown) may be provided on the outer portion of the cylindrical side 58 to provide for easy gripping of the cover 16. An annular connecting flange 60 is attached to and extends downwardly from the inner surface of the top 56. The connecting flange 60 is adapted to snap into the groove 26 of the stem 18 to releasably attach the cover 16 to the shell 12. With this configuration, it can be assured that when the connecting flange 60 is engaged with the groove 26 of the stem 18, the tip opening 42 and stem-sealing member 44 for the tip 14 will be positioned below the groove 26 such that the stem-sealing member 44 is sealed against the stem 18. This configuration assures that when the cover 16 is re-attached to the shell 12 (i.e., after use), the tip 14 is positioned in the closed position. The bottom of the connecting flange 60 includes a chamfered or tapered portion which assists in manufacturing.

A tamper-evident band 62 is formed as a lowermost portion of the cylindrical side 58 below a score line (not shown). A plurality of long leaders 64 and standard leaders 66 are provided extending across the score line for the construction of tamper-evident band 62. The leaders 64 and 66 form a frangible connection between the tamper-evident band 62 and the lowermost portion of the cylindrical side 58. The long leaders 64 will extend, below the score line, between adjacent projections 32 and combine to serve as a rotation prevention mechanism preventing relative rotation between the tamper-evident band 62 and the shell 12. Additionally, a plurality of radially inwardly extending ramp-shaped projections 68 are positioned on the inner cylindrical side 58 below the score line to be part of the tamper-evident band 62. The projections 68 are received in the undercut 31 below the projection 32 of the annular ring 30 to initially attach the cover 16 to the shell 12. Before the tamper-evident band 62 is separated from the dust cover 16 (i.e. before the first consumer use) the projections 68 attach the dust cover 16 to the shell 12. After the tamper-evident band 62 is separated from the dust cover 16, the connecting flange 60 and groove 26 are used to attach the dust cover 16 to the shell 12. The projections 68 will help retain the severed tamper-evident band 62 on the closure 10.

The key feature of the present invention is that the dust cover 16 further includes tip engaging ribs 70 formed on the inner surface of the dust cover 16. The tip engaging ribs 16 are designed to engage the tip 14 when the dust cover 16 is attached to the shell 12 as shown, schematically, in FIG. 1. The ribs 70 extend inwardly and contact the tip 14 preventing tilting of the dust cover 16 and/or the tip 14 during the closing of the closure 10 and the re-attachment of the dust cover 16 to the shell 12. A plurality of ribs 70 are radially spaced around the interior of the dust cover 16. The proper alignment achieved between the dust cover 16, tip 14 and shell 12 by the ribs 70 prevents the closure from leaking in the closed position. The engagement of the ribs 70 and the tip 14 can be used as a further securing attachment for the dust cover 16 to the closure 10 after the initial use.

The container closure 10 will generally operate as follows. The container closure 10 will be attached to an appropriate container, such as a sports drink bottle, i.e., water bottle, juice bottle, or the like, by threading the shell 12 onto an appropriately threaded container by use of threads 38. The inclusion of both tamper-evident bands 40 and 62 will provide the necessary level of security to the user. The container may, contain an optional thin foil protective cover covering the container opening which must be removed prior to use. On purchasing the product, the user can remove the shell 12 from the container by unthreading of the shell 12 which will break away the tamper-evident band 40 in the known manner. The user then will remove the thin foil (if provided) covering the container opening and replace the shell 12. To access the tip 14, the user will need to remove the cover 16 from the shell 12 which requires the separation of the tamper-evident band 62 from the cover 16. With the cover 16 removed from the shell 12, the tip 14 can be moved to the open position and the material dispensed from the container. The container is easily resealed by sliding the tip 14 to the closed position where the stem-sealing member 44 engages the stem 18 below the groove 26 to seal the tip opening 42. The replacement of the cover 16 on the shell 12 may indicate the movement of the tip 14 to the closed position by the engagement of the connecting flange 60 in the groove 26 as described above. Consequently, the cover 16 may be indicative of the tip 14 being in the closed position when the cover 16 is attached to the shell 12. The ribs 70 assure the proper closing of the closure 10.

Where the provision of a second tamper-evident band 62 on the cover 16 is not desired, the score line can be eliminated effectively preventing the formation of the tamper-evident band 62. With this configuration, the projections 68 could cooperate with the projections 32 of the annular ring 30 to form another attaching mechanism for releasably attaching the cover 16 to the shell 12. As discussed above, the connecting flange 60 and groove 26 will form a cover-attaching mechanism.

It will be appreciated by those of ordinary skill in the art that various modifications may be made to the present invention without departing from the spirit and scope thereof. The invention has been described with reference to the preferred embodiment. Obvious modifications and alterations will occur to others upon reading and understanding the proceeding detailed description. It is intended that the invention be construed as including all such modifications and alterations insofar as they come within the scope of the appended claims or the equivalents thereof.

What is claimed is:

1. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, said stem attached to said annular wall;

a tip received on said shell movable between an open position and a closed position sealing said shell opening; and a cover releasably attached to said shell, said cover including internally extending ribs engagable with said tip when said cover is attached to said shell, the cover having a top and an annular side wall, each said rib extending in a radial direction along said top of the cover and extending along the side wall of the cover.

2. The container closure of claim 1 wherein said shell further includes a cover-attaching member positioned on said stem, wherein said cover attaching member of said shell engages a shell engaging member of said cover to releasably attach said cover to said shell, and each rib extends from the shell engaging member of the cover along the top of the cover.

3. The container closure of claim 2 wherein said cover-attaching member is formed by a groove on said stem, said groove engaging said cover to releasably attach said cover to said shell, wherein the cover attaching member is above the tip when the cover-attaching member engages the shell engaging member of the cover.

4. The container closure of claim 3 wherein at least four of said ribs are radially positioned around an interior of said cover, and the tip has inner and outer sleeves engaging the shell.

5. The container closure of claim 1 wherein at least four of said ribs are radially positioned around an interior of said cover, and the tip has inner and outer sleeves engaging the shell.

6. The container closure of claim 1 wherein said cover includes a tamper-evident band removably attached to said cover at a lower end of the side wall below a tapered end of each rib.

7. The container closure of claim 6 wherein said tamper-evident band includes at least one projection extending radially inwardly of said side wall, and the tip has inner and outer sleeves engaging the shell.

8. The container closure of claim 1 wherein at least four of said ribs are provided and each said rib is attached to the top and side of said cover, and the tip has inner and outer sleeves engaging the shell.

9. The container closure of claim 1 wherein each said rib has a curved inner face adapted to engage the tin, and the tin has inner and outer sleeves engaging the shell.

10. The container closure of claim 9 wherein each said rib has a beveled lower edge adapted to center the dust cover during placement by the user.

11. The container closure of claim 1 wherein each said rib extends from a position on a top of said cover which is adjacent a cover-attaching member to a position along the side above a tamper evident band, and the tip has inner and outer sleeves engaging the shell.

12. A container closure comprising:

a shell having a body attachable to a container around a container opening thereof, said shell having a shell opening in fluid communication with the container opening when said shell is attached to the container, wherein said shell includes a central stem, said shell opening is an annular opening surrounding said stem, an annular wall extending from said body and surrounding said annular opening, said stem attached to said annular wall;

a tip received on said shell movable between an open position and a closed position sealing said shell opening; and a cover having a shell engaging member on a top of the cover for releasably attaching said cover to said shell, said cover including internally radial extending ribs extending away from the shell engaging member and engagable with said tip when said cover is attached to said shell, whereby said ribs maintain proper alignment between said cover, said tip and said shell when said cover is attached to said shell preventing said closure from leaking in the closed position.

13. The container closure of claim 12 wherein the shell has a cover attaching member and said cover attaching member is formed by a groove on said stem, said groove engaging said cover to releasably attach said cover to said shell.

14. The container closure of claim 13 wherein at least four said ribs are provided and said ribs are radially positioned around an interior of said cover, and said tip includes an inner and outer sleeve engaging the shell.

15. The container closure of claim 14 wherein said cover includes a tamper-evident band removably attached to said cover, at a position below the ribs.

* * * * *